US011060157B2

(12) United States Patent
Kohsaka et al.

(10) Patent No.: US 11,060,157 B2
(45) Date of Patent: Jul. 13, 2021

(54) STEEL SHEET, COATED STEEL SHEET, METHOD FOR PRODUCING HOT-ROLLED STEEL SHEET, METHOD FOR PRODUCING FULL HARD COLD-ROLLED STEEL SHEET, METHOD FOR PRODUCING STEEL SHEET, AND METHOD FOR PRODUCING COATED STEEL SHEET

(71) Applicant: JFE Steel Corporation, Tokyo (JP)

(72) Inventors: Noriaki Kohsaka, Tokyo (JP); Yoshimasa Funakawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 267 days.

(21) Appl. No.: 16/087,919

(22) PCT Filed: Mar. 17, 2017

(86) PCT No.: PCT/JP2017/010821

§ 371 (c)(1),
(2) Date: Sep. 24, 2018

(87) PCT Pub. No.: WO2017/169871

PCT Pub. Date: Oct. 5, 2017

(65) Prior Publication Data

US 2019/0106759 A1 Apr. 11, 2019

(30) Foreign Application Priority Data

Mar. 31, 2016 (JP) ..... JP2016-070737

(51) Int. Cl.
*C21D 8/02* (2006.01)
*C23C 2/06* (2006.01)
(Continued)

(52) U.S. Cl.
CPC ..... *C21D 8/0226* (2013.01); *C21D 1/26* (2013.01); *C21D 1/76* (2013.01); *C21D 6/005* (2013.01); *C21D 6/008* (2013.01); *C21D 7/02* (2013.01); *C21D 7/13* (2013.01); *C21D 8/0257* (2013.01); *C21D 8/0457* (2013.01); *C21D 9/46* (2013.01); *C21D 9/48* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/10* (2013.01); *C22C 38/12* (2013.01); *C22C 38/42* (2013.01); *C22C 38/44* (2013.01); *C22C 38/60* (2013.01); *C23C 2/02* (2013.01); *C23C 2/06* (2013.01); *C23C 2/28* (2013.01); *C23C 2/40* (2013.01);
(Continued)

(58) Field of Classification Search
CPC . C21D 1/26; C21D 1/76; C21D 6/004; C21D 6/005; C21D 6/007; C21D 6/008; C21D 7/02; C21D 7/13; C21D 8/0226; C21D 8/0236; C21D 8/0257; C21D 8/0263; C21D 8/0273; C21D 8/0426; C21D 8/0436; C21D 8/0463; C21D 8/0457; C21D 9/46; C21D 9/48; C21D 2211/005; C21D 2211/009; C22C 38/001; C22C 38/002; C22C 38/005; C22C 38/008; C22C 38/00; C22C 38/02; C22C 38/04; C22C 38/06; C22C 38/08; C22C 38/10; C22C 38/12; C22C 38/16; C22C 38/18; C22C 38/20; C22C 38/22; C22C 38/24; C22C 38/26; C22C 38/30; C22C 38/40; C22C 38/42; C22C 38/44; C22C 38/46; C22C 38/48; C22C 38/52; C22C 38/60; C23C 2/02; C23C 2/06
See application file for complete search history.

(56) References Cited

U.S. PATENT DOCUMENTS 5,922,145 A * 7/1999 Watari ..... C22C 38/02 148/320
6,027,581 A 2/2000 Osawa et al.
(Continued)

FOREIGN PATENT DOCUMENTS

| | | | |
|---|---|---|---|
| JP | 0344423 | A | 2/1991 |
| JP | 1060593 | A | 3/1998 |
| JP | 10219394 | A | 8/1998 |
| JP | 2004068051 | A | 3/2004 |
| JP | 2007107099 | A | 4/2007 |
| JP | 2007138261 | A | 6/2007 |
| JP | 2008138237 | A | 6/2008 |
| JP | 2010144242 | A | 7/2010 |

(Continued)

OTHER PUBLICATIONS

International Search Report and Written Opinion for International Application No. PCT/JP2017/010821, dated Jun. 20, 2017—5 pages.

*Primary Examiner* — Anthony J Zimmer
*Assistant Examiner* — Dean Mazzola
(74) *Attorney, Agent, or Firm* — Ratnerprestia

(57) ABSTRACT

Provided are coated steel sheets, production methods therefor, and so forth, the coated steel sheets having a tensile strength of 440 MPa or more, good formability, and good aging resistance. A steel sheet of the present invention includes a specific component composition and a steel microstructure having an area fraction of a ferrite phase of 80% or more and 95% or less, an area fraction of pearlite of 5% or more and 20% or less, and an average ferrite grain size of 5 μm or more and 20 μm or less, in which in a ferrite grain size histogram, the average grain size of the largest 20% of ferrite grains in terms of grain size is 10 μm or more, and the pearlite has an average lamellar spacing of 200 nm or less, the area fraction, the average ferrite grain size, and the lamellar spacing being determined by microstructure observation.

16 Claims, No Drawings

(51) Int. Cl.

| | |
|---|---|
| ***C23C 2/40*** | (2006.01) |
| ***C21D 9/46*** | (2006.01) |
| ***C22C 38/60*** | (2006.01) |
| ***C21D 7/02*** | (2006.01) |
| ***C21D 7/13*** | (2006.01) |
| ***C21D 1/26*** | (2006.01) |
| ***C21D 6/00*** | (2006.01) |
| ***C21D 8/04*** | (2006.01) |
| ***C21D 1/76*** | (2006.01) |
| ***C23C 2/02*** | (2006.01) |
| ***C21D 9/48*** | (2006.01) |
| ***C23C 2/28*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/42*** | (2006.01) |
| ***C22C 38/44*** | (2006.01) |

(52) U.S. Cl.

CPC ..... *C21D 6/004* (2013.01); *C21D 6/007* (2013.01); *C21D 8/0236* (2013.01); *C21D 8/0263* (2013.01); *C21D 8/0426* (2013.01); *C21D 8/0436* (2013.01); *C21D 8/0463* (2013.01); *C21D 2211/005* (2013.01); *C21D 2211/009* (2013.01)

(56) References Cited

U.S. PATENT DOCUMENTS

| | | | | |
|---|---|---|---|---|
| 2003/0047256 | A1 | 3/2003 | Kami et al. | |
| 2010/0139816 | A1* | 6/2010 | Hanlon | C22C 18/02 148/526 |
| 2018/0251876 | A1* | 9/2018 | Sasaki | C22C 38/04 |

FOREIGN PATENT DOCUMENTS

| | | | | |
|---|---|---|---|---|
| JP | 2013224477 | A * | 10/2013 | |
| JP | 2013224477 | A | 10/2013 | |
| WO | 0164967 | A1 | 9/2001 | |
| WO | WO-2017033773 | A1 * | 3/2017 | C22C 38/00 |

* cited by examiner

STEEL SHEET, COATED STEEL SHEET, METHOD FOR PRODUCING HOT-ROLLED STEEL SHEET, METHOD FOR PRODUCING FULL HARD COLD-ROLLED STEEL SHEET, METHOD FOR PRODUCING STEEL SHEET, AND METHOD FOR PRODUCING COATED STEEL SHEET

CROSS REFERENCE TO RELATED APPLICATIONS

This is the U.S. National Phase application of PCT/JP2017/010821, filed Mar. 17, 2017, which claims priority to Japanese Patent Application No. 2016-070737, filed Mar. 31, 2016, the disclosures of these applications being incorporated herein by reference in their entireties for all purposes.

TECHNICAL FIELD OF THE INVENTION

The present invention relates to a steel sheet, a coated steel sheet, a method for producing a hot-rolled steel sheet, a method for producing a full hard cold-rolled steel sheet, a method for producing a steel sheet, and a method for producing a coated steel sheet.

BACKGROUND OF THE INVENTION

In recent years, there has been a trend toward an improvement in the fuel economy of automobiles in the entire automotive industry in order to reduce the amount of $CO_2$ emission in view of global environmental conservation.

Good rigidity and good impact resistance of automobile bodies are provided by forming steel sheets into complex shapes, so that the amounts of steel sheets used can be reduced; thus, steel sheet having good formability can contribute to the improvement in fuel efficiency. In recent years, steel sheets having good formability have been increasingly demanded as materials for automobile parts.

In the case where steel sheets having good formability are used as for automobile parts, the adverse effect of a change with time in the formability of steel sheets cannot be negligible. That is, when steel sheets are held for long periods of time even at room temperature, dislocations inside steel sheets are fixed by interstitial elements, such as carbon and nitrogen, with high diffusion rates; thus, the quality varies markedly, in some cases. Accordingly, steel sheets used for difficult-to-form complex shapes are required to have good formability immediately after production and are also required to have good aging resistance, which indicates that the quality remains unchanged.

Various techniques for providing steel sheets with good workability and aging properties have been reported so far. For example, Patent Literature 1 discloses a galvanized steel sheet having good workability and containing, on a percent by mass basis, C: 0.003% to 0.18%, Si: 1.2% or less, Mn: 2.0% or less, sol. Al: 0.10% or less, and S: 0.005% or less, the steel sheet being provided by annealing in a region where an austenite phase and a ferrite phase are both present.

Patent Literature 2 discloses a high-strength cold-rolled steel sheet having a good balance between strength and stretch-flangeability and a microstructure containing, on a percent by mass basis, C: 0.03% to 0.17%, Si: 1.0% or less, Mn: 0.3% to 2.0%, P: 0.15% or less, S: 0.010% or less, and Al: 0.005% to 0.06%, C (%)>(3/40)×Mn (%) being satisfied, the microstructure being formed of a ferrite phase and a second phase mainly composed of a bainite phase or pearlite, the difference in hardness between the ferrite phase and the second phase being specified.

Patent Literature 3 discloses a cold-rolled steel sheet having good deep drawability and good aging resistance and containing C: more than 0.015% by weight to 0.150% by weight, Si: 1.0% or less by weight, Mn: 0.01% to 1.50% by weight, P: 0.10% or less by weight, S: 0.003% to 0.050% by weight, Al: 0.001% to less than 0.01% by weight, N: 0.0001% to 0.0050% by weight, Ti: 0.001% or more by weight, Ti(%)/[1.5×S (%)+3.4×N (%)]≤1.0, and B: 0.0001% to 0.0050% by weight.

Patent Literature 4 discloses a high-strength high-ductility hot-dip galvanized steel sheet containing, on a percent by mass basis, C: 0.005% to 0.20%, Si: 0.5% or less, Mn: 0.7% to 3.0%, P: 0.10% or less, S: 0.010% or less, Al: 0.001% to 0.20%, and N: 0.020% or less, and including a metal microstructure containing 30% or more by volume of a ferrite phase and a ferrite phase containing a second phase in its grain.

Patent Literature 5 discloses a cold-rolled steel sheet having good workability, the cold-rolled steel sheet containing, on a percent by mass basis, C: 0.04% to 0.16%, Si: 0.5% or less, Mn: 0.5% to 1.5%, P: 0.20% or less, S: 0.01% or less, Al: 0.005% to 0.10%, and N: 0.005% or less, and including a metal microstructure containing a ferrite phase, pearlite, and a bainite phase, the grain size of ferrite being controlled.

Patent Literature 1: Japanese Unexamined Patent Application Publication No. 3-44423

Patent Literature 2: Japanese Unexamined Patent Application Publication No. 10-60593

Patent Literature 3: Japanese Unexamined Patent Application Publication No. 10-219394

Patent Literature 4: Japanese Unexamined Patent Application Publication No. 2004-68051

Patent Literature 5: Japanese Unexamined Patent Application Publication No. 2007-107099

SUMMARY OF THE INVENTION

In the techniques reported in Patent Literatures 1 and 5, aging resistance is not considered, and a coiling temperature in hot rolling and annealing conditions are not optimized; thus, a steel sheet having good aging resistance is not obtained.

In the technique reported in Patent Literature 2, the ratio of the C content to the Mn content is not optimized; thus, a steel microstructure having good aging resistance is not obtained. The yield ratio is high, leading to the manifestation of the adverse effect of springback on a complex-shaped member. Furthermore, overaging treatment is needed at lower than 460° C.; thus, a hot-dip coated steel sheet is not obtained.

In the technique reported in Patent Literature 3, the tensile strength is less than 440 MPa. Components that affect aging properties are C and N that are in solid solution states. Because of low strength, the steel sheet in Patent Literature 3 is assumed to have a relatively low content of C that has an adverse effect.

In the technique reported in Patent Literature 4, the cooling rate is high during annealing to form martensite, thus leading to poor aging resistance.

In any cited literature, it is difficult to provide a steel sheet having a tensile strength of 440 MPa or more, good formability (ductility and a yield ratio), and good aging resistance. Aspects of the present invention has been accomplished in light of the foregoing circumstances and aims to provide a coated steel sheet having a tensile strength of 440 MPa or more, good formability, and good aging resistance and a production method therefor. Aspects of the present invention also aims to provide a steel sheet required to produce the coated steel sheet, a method for producing a hot-rolled steel sheet required to produce the coated steel sheet having a tensile strength of 440 MPa or more, good formability, and good aging resistance, a method for producing a full hard cold-rolled steel sheet required to produce the coated steel sheet, and a method for producing a steel sheet required to produce the coated steel sheet.

To solve the foregoing problems, the inventors have conducted intensive studies on requirements for a coated steel sheet having a tensile strength of 440 MPa or more, good formability, and good aging resistance. In the studies, the inventors have focused their attention on the fact that the amount of springback, work hardening ability, and ductility are required to obtain good formability.

The amount of springback is increased mainly by an increase in yield strength; thus, a steel sheet was designed to have low yield strength, i.e., in such a manner that a yield ratio represented by yield strength/tensile strength was low. The yield strength significantly is significantly affected by the hardness of a ferrite phase, which is a soft phase. Thus, components that increase the hardness of the ferrite phase are limited and a ferrite grain size is optimized.

The inventors have also conducted investigations on requirements for the ferrite grain size and the grain size distribution of ferrite such that maximum ductility is obtained, and have optimized the grain size distribution.

The formation of an appropriate amount of a hard phase in addition to the ferrite phase, which is a soft phase, is effective in improving the work hardening ability. Most of conventional techniques often use a martensite phase, a bainite phase, and a retained austenite phase. The inventors have conducted studies on multiple-phase steels including a ferrite phase and the foregoing phases and have found that the aging resistance is very poor. The investigation of the cause of the poor aging resistance in the case of using these microstructures revealed that dislocations seem to be formed in the ferrite phase by transformation strain and fixed by the diffusion of carbon and nitrogen. The inventors have conducted studies on requirements for the inhibition of the formation of the dislocations in the ferrite phase and have found that the use of pearlite is the best choice for the inhibition of the formation of the dislocations. It was found that in order to obtain a desired hardness by the use of pearlite, the lamellar spacing of pearlite also needs to be controlled.

These findings have led to the completion of aspects of the present invention. The outline thereof will be described below.

[1] A steel sheet includes a component composition containing, on a percent by mass basis, C: 0.14% or more and 0.19% or less, Si: 0.06% or less, Mn: 0.55% or more and 0.90% or less, P: 0.05% or less, S: 0.002% or more and 0.015% or less, Al: 0.08% or less, and N: 0.0100% or less, expression (1) described below being satisfied, the balance being Fe and incidental impurities, and a steel microstructure having an area fraction of a ferrite phase of 80% or more and 95% or less, an area fraction of pearlite of 5% or more and 20% or less, and an average ferrite grain size of 5 μm or more and 20 μm or less, in which in a ferrite grain size histogram, the average grain size of the largest 20% of ferrite grains in terms of grain size is 10 μm or more, and the pearlite has an average lamellar spacing of 200 nm or less, the area fraction, the average ferrite grain size, and the lamellar spacing being determined by microstructure observation, and in which the steel sheet has a tensile strength of 440 MPa or more, $$0.16 \leq [\%\ C]/[\%\ Mn] \leq 0.32 \quad (1)$$

where in expression (1), [% C] represents a C content (% by mass), and [% Mn] represents a Mn content (% by mass).

[2] In the steel sheet described in [1], the component composition further contains, on a percent by mass basis, one or two of Cr: 0.001% or more and 0.1% or less, and Mo: 0.001% or more and 0.1% or less.

[3] In the steel sheet described in [1] or [2], the component composition further contains, on a percent by mass basis, 1.0% or less in total of one or more of REM, Cu, Ni, Sn, Sb, Mg, Ca, Co, V, and Nb.

[4] A coated steel sheet includes a coated layer on a surface of the steel sheet described in any one of [1] to [3].

[5] In the coated steel sheet described in [4], the coated layer is a hot-dip galvanized layer or a hot-dip galvannealed layer, and the coated layer contains, on a percent by mass basis, Fe: 20.0% or less by mass, Al: 0.001% or more by mass and 1.0% or less by mass, and 0% or more by mass and 3.5% or less by mass in total of one or two or more selected from Pb, Sb, Si, Sn, Mg, Mn, Ni, Cr, Co, Ca, Cu, Li, Ti, Be, Bi, and REM, the balance being Zn and incidental impurities.

[6] A method for producing a hot-rolled steel sheet includes heating a steel having the component composition described in any one of [1] to [3] to 1,100° C. or higher and 1,300° C. or lower and subjecting the steel to hot rolling including rough rolling and finish rolling, cooling, and coiling, in which the total reduction ratio from a third pass, counting back from the final pass, to the final pass in the finish rolling is 40% or less, the finish rolling temperature is 880° C. or higher, the time from the completion of the finish rolling to the start of the cooling is 5 seconds or more, and the coiling temperature is 610° C. or higher and 690° C. or lower.

[7] A method for producing a full hard cold-rolled steel sheet includes subjecting a hot-rolled steel sheet produced by the production method described in claim [6] to cold rolling.

[8] A method for producing a steel sheet includes subjecting a full hard cold-rolled steel sheet produced by the production method described in [7] to annealing under conditions at a dew point of −40° C. or lower in a temperature range of 600° C. or higher, an annealing temperature of 740° C. or higher and 810° C. or lower, an average cooling rate of 20° C./s or less from a cooling start temperature to 700° C., and a cooling stop temperature of 200° C. or higher and 550° C. or lower.

[9] A method for producing a coated steel sheet includes coating a steel sheet produced by the production method described in [8].

The coated steel sheet provided by aspects of the present invention has a high tensile strength (TS) of 440 MPa or more, good formability, and good aging resistance. The use of the coated steel sheet of such aspects of the present invention for automotive parts achieves a further reduction in the weight of automotive parts.

The steel sheet of aspects of the present invention, the method for producing a hot-rolled steel sheet, the method for producing a full hard cold-rolled steel sheet, and the method for producing a steel sheet according to aspects of the present invention are used as an intermediate product or a method for producing an intermediate product and contribute to a reduction in the weight of automotive parts.

DETAILED DESCRIPTION OF EMBODIMENTS OF THE INVENTION

Embodiments of the present invention will be described below. The present invention is not limited to the embodiments described below.

The present invention relates to a steel sheet, a coated steel sheet, a method for producing a hot-rolled steel sheet, a method for producing a full hard cold-rolled steel sheet, a method for producing a steel sheet, and a method for producing a coated steel sheet. The relationship therebetween will first be described.

The steel sheet of the present invention is an intermediate product used for the production of the coated steel sheet of the present invention. The coated steel sheet is produced from steel such as a slab through processes for producing a hot-rolled steel sheet, a full hard cold-rolled steel sheet, and a steel sheet.

The method according to an aspect of the present invention for producing a hot-rolled steel sheet is a process for producing a hot-rolled steel sheet among the foregoing processes.

The method according to an aspect of the present invention for producing a full hard cold-rolled steel sheet is a process for producing a full hard cold-rolled steel sheet from a hot-rolled steel sheet among the foregoing processes.

The method according to an aspect of the present invention for producing a steel sheet is a process for producing a steel sheet from a full hard cold-rolled steel sheet among the foregoing processes.

The method according to an aspect of the present invention for producing a coated steel sheet is a process for producing a coated steel sheet from a steel sheet among the foregoing processes.

Because of the foregoing relationship, the hot-rolled steel sheet, the full hard cold-rolled steel sheet, the steel sheet, and the coated steel sheet share a common component composition, and the steel sheet and the coated steel sheet share a common steel microstructure. Hereinafter, a common item, the steel sheet, the coated steel sheet, and the production methods will be described in this order.

<Component Composition of Hot-Rolled Steel Sheet, Full Hard Cold-Rolled Steel Sheet, Steel Sheet, and Coated Steel Sheet>

The hot-rolled steel sheet, the full hard cold-rolled steel sheet, the steel sheet, and the coated steel sheet have a component composition containing, on a percent by mass basis, C: 0.14% or more and 0.19% or less, Si: 0.06% or less, Mn: 0.55% or more and 0.90% or less, P: 0.05% or less, S: 0.002% or more and 0.015% or less, Al: 0.08% or less, and N: 0.0100% or less, $0.16 \leq [\%\ C]/[\%\ Mn] \leq \leq 0.32$, which is expression (1), being satisfied, the balance being Fe and incidental impurities.

The component composition may further contain, on a percent by mass basis, one or two of Cr: 0.001% or more and 0.1% or less, and Mo: 0.001% or more and 0.1% or less.

The component composition may further contain, on a percent by mass basis, 1.0% or less in total of one or more of REM, Cu, Ni, Sn, Sb, Mg, Ca, Co, V, and Nb.

These components will be described below. In the following description, the symbol "%" that expresses the content of an element refers to "% by mass".

C: 0.14% or more and 0.19% or less

C is an element that forms pearlite to contribute to a substantial increase in the strength of the steel sheet. To provide a tensile strength of 440 MPa or more, the C content needs to be at least 0.14% or more. A C content of more than 0.19% results in the formation of low-temperature transformation phases such as a martensite phase and a bainite phase to decrease the aging resistance. Furthermore, the strength is excessively increased to fail to obtain formability required in aspects of the present invention. The lower limit of the C content is preferably 0.15% or more. The upper limit of the C content is preferably 0.18% or less.

Si: 0.06% or less

Si hardens a ferrite phase to increase the yield ratio. Thus, a certain amount or more of Si incorporated results in an increase in the amount of springback to fail to obtain good formability. Although the Si content is preferably minimized as much as possible, a Si content of up to 0.06% may be acceptable in the present invention. Preferably, the Si content is 0.05% or less. The lower limit thereof is not particularly set and includes 0%; however, Si can be inevitably incorporated in steel in a content of 0.001% in view of the production. Thus, usually, the Si content is often 0.001% or more.

Mn: 0.55% or more and 0.90% or less

Mn has the effect of strengthening the steel sheet by solid-solution strengthening. To provide a tensile strength of 440 MPa or more, the Mn content needs to be 0.55% or more. If the Mn content is more than 0.90%, the Acs point is lowered to form martensite, thus significantly decreasing the aging resistance. Accordingly, the Mn content is 0.55% or more and 0.90% or less. The lower limit of the Mn content is preferably 0.65% or more. The upper limit of the Mn content is preferably 0.8% or less.

To form fine pearlite, the content ratio of C, which contributes to the formation of lamellar cementite, to Mn, which controls the diffusion of C, also needs to be controlled. If [% C]/[% Mn] is less than 0.16, C is not enough at the time of the formation of pearlite, thus increasing the lamellar spacing. If [% C]/[% Mn] is more than 0.32, the diffusion rate of C and the number of cementite nuclei formed are not controlled. Also in this case, the lamellar spacing is increased. Thus, $0.16 \leq [\%\ C]/[\%\ Mn] \leq 0.32$ needs to be satisfied. The lower limit of [% C]/[% Mn] is preferably 0.18 or more. The upper limit of [% C]/[% Mn] is preferably 0.28 or less. [% M] represents a content of an element M (% by mass).

P: 0.05% or less

P is an element that segregates at grain boundaries to degrade the workability. Thus, the P content is preferably minimized as much as possible. A P content of up to 0.05% may be acceptable in the present invention. Preferably, the P content is 0.04% or less. Although the P content is preferably minimized as much as possible, P can be inevitably incorporated in a content of 0.001% in view of the production. Thus, usually, the lower limit of the P content is often 0.001% or more.

S: 0.002% or more and 0.015% or less

S forms coarse MnS in steel, and the coarse MnS acts as a ferrite nucleation site during hot rolling. The nucleation of ferrite is accelerated to initiate the transformation from austenite to ferrite at a high temperature, thus providing the steel sheet including coarse ferrite grains required according to an aspect of the present invention. To provide this effect, the S content needs to be 0.002% or more. A S content of more than 0.015% results in the degradation of formability due to MnS. Thus, the upper limit of the S content is 0.015%. The lower limit of the S content is preferably 0.003% or more. The upper limit of the S content is preferably 0.010% or less.

Al: 0.08% or less

In the case where Al is added as a deoxidizer at the stage of steel making, the Al content is preferably 0.01% or more. More preferably, the Al content is 0.02% or more. Al forms an oxide that degrades the formability. Thus, the upper limit of the Al content is 0.08%, preferably 0.07% or less.

N: 0.0100% or less

N is a harmful element that is fixed to dislocations to degrade the aging resistance. Thus, the N content is preferably minimized as much as possible. A N content of up to 0.0100% may be acceptable in the present invention. Preferably, the N content is 0.0060% or less. Although the N content is preferably minimized as much as possible, N can be inevitably incorporated in a content of 0.0005% in view of the production. Thus, the N content is often 0.0005% or more.

The foregoing components are fundamental components of the present invention. The component composition may further contain, on a percent by mass basis, one or two of Cr: 0.001% or more and 0.1% or less and Mo: 0.001% or more and 0.1% or less.

Cr and Mo contribute to a reduction in the lamellar spacing of pearlite to contribute to an increase in the strength of steel. To provide these effects, the Cr content needs to be 0.001% or more, and the Mo content needs to be 0.001% or more. If each of the Cr content and the Mo content is more than 0.1%, martensite is formed to decrease the aging resistance. Thus, the upper limit of each of the Cr content and the Mo content is 0.1%. Preferably, the total content of Cr and Mo is 0.1% or less. If each of the Cr content and the Mo content is less than the lower limit, the effects of the present invention are not impaired. When each of the Cr content and the Mo content is less than the lower limit, these elements are regarded as being contained as incidental impurities.

The component composition may contain 1.0% or less in total of one or more of REM, Cu, Ni, Sn, Sb, Mg, Ca, Co, V, and Nb. These elements are elements that can be incorporated as incidental impurities, and a total of 1.0% or less can be acceptable in view of the formability and the aging resistance. A total of 0.2% or less is preferred.

Components other the foregoing components are Fe and incidental impurities.

<Steel Microstructure of Steel Sheet and Coated Steel Sheet>

The steel microstructure of the steel sheet and coated steel sheet has an area fraction of a ferrite phase of 80% or more and 95% or less, an area fraction of pearlite of 5% or more and 20% or less, and an average ferrite grain size of 5 gm or more and 20 μm or less, in which in a ferrite grain size histogram, the average grain size of the largest 20% of ferrite grains in terms of grain size is 10 μm or more, and the pearlite has an average lamellar spacing of 200 nm or less, the area fraction, the average ferrite grain size, and the lamellar spacing being determined by microstructure observation. The values of the area fraction, the average ferrite grain size, the average grain size of the largest 20% of ferrite grains in terms of grain size, and the average lamellar spacing indicate values obtained by methods described in examples.

Area Fraction of Ferrite Phase: 80% or more and 95% or less

In one embodiment of the present invention, good formability is obtained by the ferrite phase. To obtain formability required in aspects of the present invention, the area fraction of the ferrite phase needs to be 80% or more. Because the ferrite phase is a soft microstructure, if the area fraction of the ferrite phase is more than 95%, a tensile strength of 440 MPa is not obtained. Thus, the area fraction of the ferrite phase is 80% or more and 95% or less. The lower limit of the area fraction thereof is preferably 82% or more. The upper limit of the area fraction thereof is preferably 92% or less.

Average Ferrite Grain Size: 5 μm or more and 20 μm or less

Average Grain Size of Largest 20% of Ferrite Grains: 10 μm or more

Although the ferrite phase is a soft microstructure, the formability markedly varies with the grain size. That is, coarse ferrite grains results in a soft microstructure. To obtain better formability, each of the initial stage of plastic deformation near a yield point and the intermediate and the subsequent stages, where the strain is 5% or more, of the plastic deformation needs to be controlled. In the initial stage of plastic deformation, ferrite grains having a larger grain size yield preferentially. The plastically deformed ferrite grains are hardened by dislocation strengthening and can promote the deformation of ferrite grains that do not yield. Thus, when the ferrite grains have a distributed grain size (grain size distribution), a steel sheet having better formability is provided. An excessively large ferrite grain size results in the formation of a pattern reflecting the shape of the ferrite grains on surfaces of the steel sheet to degrade the surface quality. Accordingly, the average ferrite grain size is 5 μm or more and 20 μm or less, and in the ferrite grain size histogram, the average grain size of the largest 20% of the ferrite grains in terms of grain size (the average grain size of the top 20% of the ferrite grain size) is 10 μm or more. The lower limit of the average ferrite grain size is preferably 6 μm or more. The upper limit of the average ferrite grain size is preferably 19 μm or less. The average grain size of the top 20% of the ferrite grain size is preferably 12 μm or more. The average grain size of the top 20% of the ferrite grain size is preferably 25 μm or less.

Area Fraction of Pearlite: 5% or More and 20% or Less

Pearlite has a structure in which hard lamellar cementite and a ferrite phase are alternately stacked and has the effect of increasing the strength of the steel sheet. To obtain a tensile strength of 440 MPa or more, the area fraction of pearlite needs to be 5% or more. An area fraction of pearlite of more than 20% results in a significant degradation of formability. Thus, the upper limit of the area fraction of pearlite is 20%. The lower limit of the area fraction thereof is preferably 8% or more. The upper limit of the area fraction thereof is preferably 18% or less.

Average Lamellar Spacing of Pearlite: 200 nm or Less

The strength of pearlite depends on the thickness of the ferrite phase surrounding lamellar cementite (lamellar spacing). If the ferrite phase, which is a soft phase, has a large thickness, a desired strength of the steel sheet is not obtained. To obtain a tensile strength of 440 MPa, the average lamellar spacing needs to be 200 nm or less, preferably 180 nm or less. Although the lower limit is not particularly set, the lower limit of the lamellar spacing of steel obtained in embodiments of the present invention is about 20 nm.

Other microstructures include a bainite phase, a martensite phase, and a retained austenite phase. These phases need not be present in the present invention. When these phases are contained, the total area fraction thereof is preferably 1% or less.

<Steel sheet>

The component composition and the steel microstructure of the steel sheet are as described above. The thickness of the steel sheet is usually, but not particularly limited to, 0.1 mm or more and 3.2 mm or less.

<Coated Steel Sheet>

The coated steel sheet according to an embodiment of the present invention is a coated steel sheet including a coated layer on the steel sheet of an embodiment of the present invention. The type of the coated layer is not particularly limited. For example, the coated layer may be a hot-dip coated layer or an electroplated layer. The coated layer may be an alloyed coated layer. The coated layer is preferably a galvanized layer. The galvanized layer may contain Al and Mg. In addition, hot-dip zinc-aluminum-magnesium alloy coating (a Zn—Al—Mg coated layer) is also preferred. In this case, the coated layer preferably has an Al content of 1% or more by mass and 22% or less by mass and a Mg content of 0.1% or more by mass and 10% or less by mass, the remainder being Zn. In addition to Zn, Al, and Mg, the Zn—Al—Mg coated layer may contain 1% or less by mass in total of one or more selected from Si, Ni, Ce, and La. The coating metal is not particularly limited. Thus, for example, an Al coating other than the Zn coating as described above may be used. The coating metal is not particularly limited. Thus, for example, an Al coating other than the Zn coating as described above may be used.

The composition of the coated layer is not particularly limited. A common component may be used. For example, in the case of a hot-dip galvanized layer or a hot-dip galvannealed layer, the coated layer is a hot-dip galvanized layer or a hot-dip galvannealed layer containing, on a percent by mass basis, Fe: 20.0% or less by mass, Al: 0.001% or more by mass and 1.0% or less by mass, and 0% or more by mass and 3.5% or less by mass in total of one or two or more selected from Pb, Sb, Si, Sn, Mg, Mn, Ni, Cr, Co, Ca, Cu, Li, Ti, Be, Bi, and REM, the balance being Zn and incidental impurities. Usually, the hot-dip galvanized layer has an Fe content of 0 to 5.0% by mass, and the hot-dip galvannealed steel sheet has an Fe content of more than 5.0% by mass and 20.0% or less by mass.

<Method for Producing Hot-Rolled Steel Sheet>

The method according to an embodiment of the present invention for producing a hot-rolled steel sheet includes heating a steel having the component composition described in Section <Component Composition of Hot-Rolled Steel Sheet, Full Hard Cold-Rolled Steel Sheet, Steel Sheet, and Coated Steel Sheet> described above to 1,100° C. or higher and 1,300° C. or lower and subjecting the steel to hot rolling including rough rolling and finish rolling, cooling, and coiling, in which the total reduction ratio from a third pass, counting back from the final pass, to the final pass in the finish rolling is 40% or less, the finish rolling temperature is 880° C. or higher, the time from the completion of the finish rolling to the start of the cooling is 5 seconds or more, and the coiling temperature is 610° C. or higher and 690° C. or lower. These conditions will be described below. In the following description, the temperature indicates the surface temperature of the steel sheet unless otherwise specified. The surface temperature of the steel sheet can be measured with, for example, a radiation thermometer. The average cooling rate indicates ((surface temperature before cooling—surface temperature after cooling)/cooling time).

Production of Steel

A steelmaking method for the production of the steel described above is not particularly limited, and a known steelmaking method using, for example, a converter or an electric furnace may be employed. Secondary refining may be performed in a vacuum degassing furnace. Then a slab (steel) is preferably formed by a continuous casting process in view of productivity and quality. The slab may also be formed by a known casting process such as an ingot-casting and slabbing-rolling process or a thin slab continuous casting process.

Heating Temperature of Steel: 1,100° C. or Higher and 1,300° C. or Lower

In at least one embodiment of the present invention, the steel needs to be heated to form the steel microstructure of the steel into a substantially uniform austenite phase before the rough rolling. To inhibit the formation of coarse inclusions, the control of the heating temperature is important. If the heating temperature is lower than 1,100° C., a desired finishing delivery temperature cannot be obtained. If the heating temperature is higher than 1,300° C., scale loss is increased to increase damage to the furnace body of a furnace. Accordingly, the heating temperature of the steel is 1,100° C. or higher and 1,300° C. or lower. The lower limit of the heating temperature is preferably 1,120° C. or higher. The upper limit of the heating temperature is preferably 1,260° C. or lower.

Rough-rolling conditions after the heating are not particularly limited.

Total Reduction Ratio from Third Pass, Counting Back from Final Pass, to Final Pass Is 40% or Lower In the finish rolling, it is necessary to promote the recrystallization of austenite to form coarse ferrite grains having a distributed grain size. To obtain desired ferrite grains, the total reduction ratio from a third pass, counting back from the final pass, to the final pass in the finish rolling needs to be 40% or less. Preferably, the total reduction ratio from the third pass, counting back from the final pass, to the final pass in the finish rolling is 35% or less. Because of production limitations, the fact that the total reduction ratio from the third pass, counting back from the final pass, to the final pass in the finish rolling is less than 10% is difficult to obtain. The total reduction ratio from the third pass, counting back from the final pass, to the final pass in the finish rolling is preferably 10% or more also in view of the grain growth of austenite.

Finishing Delivery Temperature: 880° C. or Higher

Start of Cooling 5 Seconds or More After Completion of Finish Rolling

To promote the grain growth of austenite, it is necessary to complete the finish rolling at a high temperature and maintain the high temperature. From such a point of view, the finishing delivery temperature needs to be 880° C. or higher, and the time that elapses before the start of the cooling (forced cooling) after the completion of the finish rolling needs to be 5 seconds or more. Preferably, after the finish rolling is completed at 890° C. or higher, the time that elapses before is 6 seconds or more. Although the upper limit of the finishing delivery temperature is not particularly limited, because of production limitations, the upper limit thereof is 1,000° C. The upper limit of the time that elapses before the start of the forced cooling is limited to the length of a run out table and thus varies depending on the production plant. Actually, in order to obtain a coiling temperature of 690° C. or lower, the upper limit thereof is 20 seconds.

After the completion of the finish rolling, the rolled steel sheet is usually air-cooled until the start of the forced cooling. However, holding the rolled steel sheet at a high temperature is important to promote the grain growth of austenite. Thus, instead of the air cooling, the steel sheet may be heated to 880° C. or higher and 1,000° C. or lower during the retention.

The forced cooling is usually water cooling. The average cooling rate of the forced cooling is not particularly limited. In the case of water cooling, the average cooling rate is 5°

C./s or more. An average cooling rate of 150° C./s or less is preferred from the viewpoint of inhibiting variations in coiling temperature.

The cooling stop temperature in the forced cooling is not particularly limited. In the case where the run out table is not equipped with a heating device, the cooling stop temperature is preferably 610° C. or higher and 700° C. or lower because the coiling temperature is easily controlled to a desired range. In the case where there is no time for air cooling between the stop of the cooling and the coiling, the cooling stop temperature is preferably 690° C. or lower.

The cooling stop temperature may be or may not be equal to the coiling temperature. When the cooling stop temperature is not equal to the coiling temperature, for example, when the coiling temperature is set to be lower than the cooling stop temperature, the temperature of the steel sheet may be lowered to a desired coiling temperature by, for example, performing further air cooling after the stop of the cooling.

Coiling Temperature: 610° C. or Higher and 690° C. or Lower

The ferrite grains need to be subjected to further grain growth during the coiling. To this end, the coiling temperature needs to be 610° C. or higher. If the coiling temperature is higher than 690° C., the surface quality is degraded by scale formed on the surfaces, and a coiler is damaged. Thus, the coiling temperature is in the range of 610° C. or higher and 690° C. or lower. The lower limit of the coiling temperature is preferably 620° C. or higher. The upper limit of the coiling temperature is preferably 680° C. or lower.

After the coiling, the steel sheet is cooled by, for example, air cooling and then is used for the production of the full hard cold-rolled steel sheet described below. In the case where the hot-rolled steel sheet is treated as merchandise to be sold as an intermediate product, usually, the hot-rolled steel sheet in a state of being cooled after the coiling is treated as merchandise to be sold.

<Method for Producing Full Hard Cold-Rolled Steel Sheet>

The method for producing a full hard cold-rolled steel sheet is a method for producing a full hard cold-rolled steel sheet by subjecting a hot-rolled steel sheet produced by the foregoing production method to cold rolling.

Cold-rolling conditions are appropriately set in view of, for example, a desired thickness and so forth. Typically, the cold-rolling reduction ratio is 20% or more and 95% or less.

Pickling may be performed before the cold rolling. Pickling conditions may be appropriately set.

<Method for Producing Steel Sheet>

The method of an embodiment of the present invention for producing a steel sheet is a method that includes subjecting a full hard cold-rolled steel sheet produced by the production method described above to annealing under conditions at a dew point of −40° C. or lower in a temperature range of 600° C. or higher, an annealing temperature of 740° C. or higher and 810° C. or lower, an average cooling rate of 20° C./s or less from a cooling start temperature to 700° C., and a cooling stop temperature of 200° C. or higher and 550° C. or lower. After this annealing, temper rolling may be performed, as needed.

Dew Point in Temperature Range of 600° C. or Higher: −40° C. or Lower

Setting the dew point in a temperature range of 600° C. or higher to −40° C. or lower can inhibit decarbonization from the surfaces of the steel sheet during the annealing to stably produce the steel sheet having a tensile strength of 440 MPa or more specified according to an aspect of the present invention. If the dew point is a high dew point of higher than −40° C., the steel sheet has a strength of less than 440 MPa because of the decarbonization, in some cases. Thus, the dew point in the temperature range is −40° C. or lower. The lower limit of the dew point of an atmosphere is preferably, but not necessarily, −80° C. or higher because the effect is saturated at lower than −80° C., facing a cost disadvantage. The temperature in the temperature range is based on the surface temperature of the steel sheet. That is, when the surface temperature of the steel sheet is in the temperature range described above, the dew point is adjusted in the range described above.

Annealing Temperature: 740° C. or higher and 810° C. or lower

In the annealing, the steel sheet needs to be heated to a high temperature to the extent that martensite is not formed. If the annealing temperature is lower than 740° C., a desired ferrite phase is not obtained, and because a recrystallized microstructure is left, the formability is significantly degraded. If the annealing temperature is higher than 810° C., the martensite phase is formed to decrease the aging resistance. Thus, the annealing temperature is 740° C. or higher and 810° C. or lower. The lower limit of the annealing temperature is preferably 750° C. or higher. The upper limit of the annealing temperature is preferably 800° C. or lower.

The holding time at the annealing temperature is preferably, but not necessarily, 10 seconds or more and 300 seconds or less. A constant temperature may be or may not be maintained as long as the annealing temperature is in the range of 740° C. or higher and 810° C. or lower.

Average Cooling Rate from Cooling Start Temperature to 700° C.: 20° C./s or less In a temperature range of 700° C. or higher, the ferrite grains can be subjected to grain growth in a short time. Thus, the cooling rate needs to be minimized as much as possible in view of the grain growth of the ferrite grains. In one aspect of the present invention, the average cooling rate is 20° C./s or less, preferably 15° C./s or less. The average cooling rate depends on the length of a line in a plant and is often substantially 1° C./s or more.

The cooling start temperature is the annealing temperature and thus may be 740° C. or higher and 810° C. or lower.

Cooling Stop Temperature in Cooling: 200° C. or Higher and 550° C. or Lower

After the cooling to 700° C., in order to fix C and N present in grains in a solid-solution state to improve the aging resistance, the steel sheet needs to, be held at 200° C. or higher. A cooling stop temperature of higher than 550° C. results in the formation of an oxide and so forth on the surfaces to degrade the surface quality. Thus, the steel sheet is cooled to 200° C. or higher and 550° C. or lower. The lower limit of the cooling stop temperature is preferably 220° C. or higher. The upper limit of the cooling stop temperature is preferably 540° C. or lower.

The average cooling rate in the cooling from 700° C. to 200° C. or higher and 550° C. or lower is not particularly limited. As with the case of the temperature range from the cooling stop temperature to 700° C., the average cooling rate may be or may not be 20° C./s or less. Usually, the average cooling rate is 2° C./s or more and 100° C./s or less.

Elongation Percentage in Temper Rolling: 0.6% or Less

The temper rolling is performed after the cooling to 450° C. or higher and 550° C. or lower, as needed. Dislocations are introduced by the temper rolling, thereby decreasing the aging resistance. Thus, the elongation percentage in the temper rolling is preferably 0.6% or less. The elongation percentage in the temper rolling is preferably 0.2% or more in view of the sheet-surface quality and the sheet shape.

In the case where the steel sheet is treated as merchandise to be sold, usually, the steel sheet that is cooled to room temperature after cooling to a cooling stop temperature of 200° C. or higher and 550° C. or lower or after the temper rolling is treated as merchandise to be sold.

<Method for Producing Coated Steel Sheet>

The method of the present invention for producing a coated steel sheet is a method for producing a coated steel sheet by subjecting the steel sheet produced as described above to coating. The type of a coating method is not particularly limited. The coating method may be hot-dip coating, electroplating, or the like. Specifically, a coated layer may be formed by hot-dip galvanizing treatment or treatment in which alloying is performed after hot-dip galvanization. A coated layer may be formed by electroplating such as Zn—Ni alloy electroplating. Hot-dip zinc-aluminum-magnesium alloy coating may be performed. The term "coating" includes the case of performing hot-dip coating treatment and then alloying treatment. The following description is made by taking the hot-dip galvanization as an example.

The hot-dip coating is performed by a method in which a steel sheet is immersed in a coating bath. In this method, the temperature of the steel sheet (thin steel sheet) to be immersed in the coating bath needs to be adjusted to 450° C. or higher and 550° C. or lower. At a temperature outside the temperature range of 450° C. to 550° C., foreign matter is formed in the coating bath, and the temperature of the coating bath cannot be controlled. Thus, the steel sheet is adjusted so as to have a temperature of 450° C. or higher and 550° C. or lower. The lower limit of the temperature is preferably 460° C. or higher. The upper limit of the temperature is preferably 540° C. or lower.

After the hot-dip coating, alloying treatment may be performed, as needed. The treatment temperature and the treatment time in the alloying treatment are not particularly limited and may be appropriately set.

As described in the explanation of the coating layer, Zn coating is preferred. However, coating treatment using another metal, such as Al coating, may be used.

After a steel sheet is produced in a continuous hot-dip coating line, a coated steel sheet may be immediately produced using the steel sheet.

EXAMPLES OF EMBODIMENTS OF THE INVENTION

Steels having component compositions given in Table 1 and having a thickness of 250 mm were subjected to hot rolling under hot-rolling conditions given in Table 2 to form hot-rolled steel sheets. The hot-rolled steel sheets were subjected to cold rolling at a cold-rolling reduction ratio of 40% or more and 80% or less to form cold-rolled sheets. The cold-rolled sheets were subjected to annealing under annealing conditions given in Table 2 in a continuous hot-dip coating line. Then coating treatment and, as needed, alloying treatment were performed. A coating bath (coating composition: Zn-0.13% by mass Al) used in the continuous hot-dip coating line had a temperature of 460° C. The GI materials (hot-dip coated steel sheets) and the GA materials (hot-dip alloy-coated steel sheets) each had a coating weight of 45 g/m$^2$ or more and 65 g/m$^2$ or less per side. In the case of a hot-dip galvannealed layer, the galvannealed layer had an Fe content of 6% or more by mass and 14% or less by mass. In the case of a hot-dip galvanized layer, the galvanized layer had an Fe content of 4% or less by mass.

Test pieces were sampled from the hot-dip Coated steel sheets or the hot-dip alloy-coated steel sheets produced as described above and evaluated by methods described below.

TABLE 1

| Steel | Component composition (% by mass) | | | | | | | | | |
|---|---|---|---|---|---|---|---|---|---|---|
| No. | C | Si | Mn | P | S | Al | N | Others | Expression (1) | Remarks |
| A | 0.18 | 0.03 | 0.68 | 0.02 | 0.007 | 0.05 | 0.0045 | — | 0.26 | Example |
| B | 0.15 | 0.03 | 0.79 | 0.01 | 0.007 | 0.05 | 0.0048 | Co: 0.002 | 0.19 | Example |
| C | 0.17 | 0.03 | 0.71 | 0.02 | 0.010 | 0.04 | 0.0027 | Cr: 0.05<br>Mo: 0.03<br>Cu: 0.03<br>Ni: 0.07<br>Ca: 0.0012 | 0.24 | Example |
| D | 0.14 | 0.04 | 0.62 | 0.01 | 0.009 | 0.04 | 0.0040 | V: 0.01<br>Sn: 0.0006<br>Sb: 0.009<br>Mg: 0.0008 | 0.23 | Example |
| E | 0.16 | 0.02 | 0.75 | 0.01 | 0.007 | 0.03 | 0.0035 | Nb: 0.01<br>REM: 0.0009 | 0.21 | Example |
| F | 0.12 | 0.01 | 0.58 | 0.02 | 0.006 | 0.05 | 0.0035 | — | 0.21 | Comparative example |
| G | 0.15 | 0.05 | 0.51 | 0.01 | 0.005 | 0.04 | 0.0043 | — | 0.29 | Comparative example |
| H | 0.18 | 0.03 | 0.95 | 0.02 | 0.005 | 0.04 | 0.0039 | — | 0.19 | Comparative example |
| I | 0.16 | 0.05 | 0.84 | 0.01 | 0.001 | 0.05 | 0.0026 | — | 0.19 | Comparative example |
| J | 0.19 | 0.01 | 0.56 | 0.02 | 0.007 | 0.03 | 0.0043 | — | 0.34 | Comparative example |
| K | 0.14 | 0.03 | 0.88 | 0.02 | 0.003 | 0.04 | 0.0042 | — | 0.15 | Comparative example |

TABLE 2

| Steel sheet No. | Steel | Hot rolling process: Slab heating temperature (° C.) | Total reduction ratio in finish rolling*1 (%) | Finishing delivery temperature (° C.) | Cooling start time (s)*2 | Coiling temperature (° C.) | Cold rolling reduction ratio (%) |
|---|---|---|---|---|---|---|---|
| 1 | A | 1180 | 30 | 940 | 9 | 620 | 66 |
| 2 | | 1220 | 25 | 900 | 9 | 660 | 74 |
| 3 | | 1220 | 45 | 970 | 6 | 630 | 74 |
| 4 | | 1210 | 29 | 860 | 7 | 650 | 71 |
| 5 | | 1200 | 32 | 940 | 3 | 640 | 74 |
| 6 | | 1130 | 34 | 920 | 8 | 590 | 55 |
| 7 | | 1240 | 35 | 990 | 6 | 660 | 75 |
| 8 | | 1220 | 23 | 900 | 11 | 680 | 68 |
| 9 | B | 1120 | 33 | 950 | 6 | 630 | 65 |
| 10 | | 1230 | 35 | 900 | 10 | 620 | 60 |
| 11 | C | 1200 | 30 | 980 | 8 | 630 | 67 |
| 12 | | 1130 | 31 | 980 | 11 | 660 | 55 |
| 13 | D | 1240 | 28 | 920 | 11 | 650 | 76 |
| 14 | E | 1200 | 28 | 920 | 10 | 670 | 55 |
| 15 | F | 1160 | 26 | 900 | 11 | 660 | 59 |
| 16 | G | 1190 | 28 | 950 | 6 | 620 | 62 |
| 17 | H | 1220 | 25 | 890 | 7 | 620 | 51 |
| 18 | I | 1180 | 32 | 910 | 9 | 660 | 69 |
| 19 | J | 1140 | 26 | 970 | 6 | 640 | 59 |
| 20 | K | 1250 | 26 | 980 | 6 | 630 | 80 |
| 21 | A | 1240 | 24 | 910 | 8 | 630 | 63 |

| Steel sheet No. | Annealing process: Dew point in temperature range of 600° C. or higher (° C.) | Annealing temperature (° C.) | Cooling rate (° C./s)*3 | Cooling stop temperature (° C.) | Alloying temperature (° C.) | Remarks |
|---|---|---|---|---|---|---|
| 1 | −45 | 787 | 10 | 489 | — | Example |
| 2 | −47 | 795 | 12 | 472 | 510 | Example |
| 3 | −44 | 763 | 13 | 470 | 540 | Comparative example |
| 4 | −44 | 781 | 15 | 515 | 520 | Comparative example |
| 5 | −44 | 788 | 13 | 503 | 520 | Comparative example |
| 6 | −44 | 763 | 11 | 476 | 520 | Comparative example |
| 7 | −44 | 842 | 15 | 519 | 520 | Comparative example |
| 8 | −44 | 763 | 23 | 524 | 530 | Comparative example |
| 9 | −50 | 763 | 9 | 491 | — | Example |
| 10 | −51 | 774 | 11 | 495 | 530 | Example |
| 11 | −48 | 763 | 11 | 480 | — | Example |
| 12 | −48 | 775 | 15 | 498 | 500 | Example |
| 13 | −51 | 760 | 10 | 506 | — | Example |
| 14 | −52 | 776 | 12 | 268 | — | Example |
| 15 | −48 | 760 | 15 | 487 | 510 | Comparative example |
| 16 | −48 | 796 | 14 | 475 | 500 | Comparative example |
| 17 | −49 | 795 | 13 | 490 | 520 | Comparative example |
| 18 | −50 | 766 | 11 | 517 | 530 | Comparative example |
| 19 | −48 | 778 | 7 | 502 | 530 | Comparative example |
| 20 | −47 | 788 | 13 | 470 | 520 | Comparative example |
| 21 | −38 | 790 | 11 | 481 | 520 | Comparative example |

*1Total reduction ratio from third pass, counting back from final pass, to final pass
*2Time from completion of finish rolling to start of cooling
*3Average cooling rate from cooling start temperature to 700° C.

(i) Microstructure Observation

The area fractions of phases were evaluated by a method described below. A test piece was cut out from each of the steel sheets in such a manner that a section of the test piece in the thickness direction, the section being parallel to the rolling direction, was an observation surface. The central portion thereof in the sheet-thickness direction was etched with 1% nital. Images of 10 fields of view of a portion of each steel sheet were photographed with a scanning electron microscope at a magnification of 2,000×, the portion being located away from a surface of the sheet by ¼ of the thickness of the sheet. A ferrite phase refers to a microstructure in which corrosion marks and cementite are not observed in grains. Pearlite refers to a microstructure in which two or more cementite lamellae that appear as white lines are observed. Pearlite includes degenerate pearlite, in which cementite is fragmented. The ferrite phase and pearlite were isolated from each other by image analysis, and the area fractions thereof were determined with respect to the field of view. A phase other than ferrite phase or pearlite was a martensite phase.

Regarding the ferrite grain size, the average ferrite grain size was determined as follows: Only ferrite grains were extracted from each of the resulting scanning electron micrographs of 10 fields of view by an image analysis method. The equivalent circle diameters corresponding to the areas of the ferrite grains were determined, and the average value thereof was calculated. The average grain size of the largest 20% of the ferrite grains in terms of grain size was determined as follows: The histogram of the distribution of the ferrite grain size was made. Ferrite grains corresponding to the greatest 20% by number of all the measured ferrite grains were extracted, and the average value (coarse ferrite grain size) was calculated.

The lamellar spacing of pearlite was determined as follows: The middle portion of the steel sheet in the sheet-thickness direction was defined as an observation object and magnified to a magnification of 150,000× with a transmission electron microscope. Then 20 grains of pearlite were analyzed to determine the thickness of a ferrite phase in pearlite. This was defined as the lamellar spacing of pearlite. The average value thereof was presented in Table 3.

(ii) Tensile Test

A JIS No. 5 tensile test piece was produced from each of the resulting steel sheets in a direction perpendicular to the rolling direction. A tensile test according to JIS Z 2241 (2011) was performed five times. The average yield strength (YS), the tensile strength (TS), and the total elongation (El) were determined. The cross-head speed was 10 mm/min in the tensile test. In Table 3, the steel sheets having a tensile strength of 440 MPa or more were regarded as steel sheets having mechanical properties required by one aspect of the present invention. The formability is largely concerned with the yield ratio (=YS/TS) and the work hardening ability. Regarding the work hardening ability, the true stress and true strain were determined from the tensile test results to calculate n values obtained in the range of the yield point to a strain of 5% and in the range of a strain of 5% to a strain of 10% on the basis of the n-th power hardening law. Steel sheets which had a yield ratio of 0.64 or less and in which the n value obtained in the range of the yield point to a strain of 5% was 0.160 or more and the n value obtained in the range of a strain of 5% to a strain of 10% was 0.180 or more were regarded as steel sheets required by one aspect of the present invention.

(iii) Evaluation of Aging Resistance

The formability is markedly inhibited by a change in elongation due to aging. In general, an evaluation performed by heating to 100° C. after the application of strain is widely used. However, the time degradation of an actual cold-rolled steel strip, to which no strain is applied after the production, is not accurately evaluated by the evaluation. For more accurate evaluation, after the steel sheet was held at 80° C. for 2.5 hours without applying strain, the tensile test described in (ii) was performed. The total elongation was compared with that before the steel sheet was heated and held. Steel sheets having a reduction in elongation of 2% or less were regarded as those required by one aspect of the present invention.

TABLE 3

| | | Microstructure of steel sheet | | | | | |
|---|---|---|---|---|---|---|---|
| Steel sheet No. | Surface state | Area fraction of ferrite (%) | Area fraction of pearlite (%) | Metal microstructure *1 | Average grain size of ferrite (μm) | Grain size of coarse ferrite*2 (μm) | Lamellar spacing of pearlite (nm) |
| 1 | GI material | 91 | 9 | F + P | 15 | 17 | 114 |
| 2 | GA material | 90 | 10 | F + P | 10 | 20 | 88 |
| 3 | GA material | 84 | 16 | F + P | 6 | 8 | 118 |
| 4 | GA material | 91 | 9 | F + P | 4 | 8 | 64 |
| 5 | GA material | 86 | 14 | F + P | 4 | 7 | 75 |
| 6 | GA material | 82 | 18 | F + P | 6 | 9 | 116 |
| 7 | GA material | 78 | 4 | F + P + M | 11 | 22 | 68 |
| 8 | GA material | 83 | 17 | F + P | 4 | 8 | 62 |
| 9 | GI material | 86 | 14 | F + P | 9 | 19 | 108 |
| 10 | GA material | 84 | 16 | F + P | 14 | 22 | 102 |
| 11 | GI material | 90 | 10 | F + P | 10 | 16 | 69 |
| 12 | GA material | 87 | 13 | F + P | 13 | 20 | 117 |
| 13 | GA material | 90 | 10 | F + P | 11 | 20 | 85 |
| 14 | CR material | 90 | 10 | F + P | 15 | 18 | 110 |
| 15 | GA material | 96 | 4 | F + P | 15 | 18 | 189 |
| 16 | GA material | 94 | 6 | F + P | 9 | 17 | 88 |
| 17 | GA material | 91 | 3 | F + P + M | 10 | 18 | 74 |
| 18 | GA material | 90 | 10 | F + P | 6 | 9 | 87 |
| 19 | GA material | 84 | 16 | F + P | 13 | 20 | 237 |
| 20 | GA material | 86 | 14 | F + P | 11 | 22 | 218 |
| 21 | GA material | 90 | 10 | F + P | 12 | 18 | 93 |

| | Mechanical properties of steel sheet | | | | | | | |
|---|---|---|---|---|---|---|---|---|
| Steel sheet No. | Yield strength (MPa) | Tensile strength (MPa) | Yield ratio*3 | Elongation (%) | n value (−5%)*4 | n value (5-10%)*5 | Amount of change in elongation*6 (%) | Remarks |
| 1 | 291 | 462 | 0.63 | 46 | 0.164 | 0.187 | 0 | Example |
| 2 | 283 | 456 | 0.62 | 44 | 0.167 | 0.185 | −1 | Example |
| 3 | 299 | 453 | 0.66 | 43 | 0.158 | 0.176 | −1 | Comparative example |
| 4 | 320 | 477 | 0.67 | 42 | 0.156 | 0.175 | −1 | Comparative example |
| 5 | 302 | 450 | 0.67 | 42 | 0.157 | 0.175 | −1 | Comparative example |
| 6 | 316 | 479 | 0.66 | 45 | 0.159 | 0.178 | 0 | Comparative example |
| 7 | 394 | 668 | 0.59 | 32 | 0.166 | 0.177 | −5 | Comparative example |
| 8 | 310 | 469 | 0.66 | 42 | 0.159 | 0.177 | −1 | Comparative example |
| 9 | 271 | 452 | 0.60 | 42 | 0.166 | 0.187 | −1 | Example |
| 10 | 289 | 452 | 0.64 | 43 | 0.166 | 0.187 | 0 | Example |
| 11 | 312 | 487 | 0.64 | 44 | 0.164 | 0.186 | −1 | Example |
| 12 | 298 | 488 | 0.61 | 43 | 0.167 | 0.186 | 0 | Example |

TABLE 3-continued

| | | | | | | | | |
|---|---|---|---|---|---|---|---|---|
| 13 | 282 | 441 | 0.64 | 45 | 0.160 | 0.181 | −1 | Example |
| 14 | 288 | 463 | 0.62 | 46 | 0.166 | 0.188 | −1 | Example |
| 15 | 251 | 392 | 0.64 | 46 | 0.164 | 0.184 | 0 | Comparative example |
| 16 | 265 | 428 | 0.62 | 46 | 0.167 | 0.187 | 0 | Comparative example |
| 17 | 300 | 468 | 0.64 | 43 | 0.166 | 0.184 | −4 | Comparative example |
| 18 | 316 | 471 | 0.67 | 43 | 0.158 | 0.179 | −1 | Comparative example |
| 19 | 253 | 421 | 0.60 | 43 | 0.163 | 0.183 | 0 | Comparative example |
| 20 | 260 | 433 | 0.60 | 45 | 0.167 | 0.187 | 0 | Comparative example |
| 21 | 258 | 430 | 0.60 | 45 | 0.165 | 0.185 | −1 | Comparative example |

*1F: ferrite, P: pearlite, M: martensite

*2Coarse ferrite grain size = average grain size of largest 20% of all ferrite grains in terms of grain size

*3 Yield ratio = yield strength/tensile strength

*4n value from true stress in range of yield point to a strain of 5%

*5 n value from true stress in range of a strain of 5% to a strain of 10%

*6(Elongation obtained by tensile test using test piece that has been held at 80° C. for 2.5 hours) − (elongation obtained by tensile test under normal conditions)

The invention claimed is:

1. A steel sheet comprising:

a component composition containing, on a percent by mass basis:

C: 0.14% or more and 0.19% or less,

Si: 0.06% or less,

Mn: 0.55% or more and 0.90% or less,

P: 0.05% or less,

S: 0.002% or more and 0.015% or less,

Al: 0.08% or less, and

N: 0.0100% or less, expression (1) described below being satisfied, the balance being Fe and incidental impurities; and a steel microstructure having an area fraction of a ferrite phase of 80% or more and 95% or less, an area fraction of pearlite of 5% or more and 20% or less, and an average ferrite grain size of 5 μm or more and 20 μm or less, wherein in a ferrite grain size histogram, an average grain size of a largest 20% of ferrite grains in terms of grain size is 10 μm or more, and the pearlite has an average lamellar spacing of 200 nm or less, the area fraction, the average ferrite grain size, and the lamellar spacing being determined by microstructure observation, and wherein the steel sheet has a tensile strength of 440 MPa or more, $$0.16 \leq [\%\ C]/[\%\ Mn] \leq 0.32 \quad (1)$$

where in expression (1), [% C] represents a C content (% by mass), and [% Mn] represents a Mn content (% by mass).

2. The steel sheet according to claim 1, wherein the component composition further contains, on a percent by mass basis, one or two selected from the following groups A to B:

Group A:

one or two of: Cr: 0.001% or more and 0.1% or less, and Mo: 0.001% or more and 0.1% or less Group B:

1.0% or less in total of one or more of REM, Cu, Ni, Sn, Sb, Mg, Ca, Co, V, and Nb.

3. A coated steel sheet comprising a coated layer on a surface of the thin steel sheet according to claim 1.

4. A coated steel sheet comprising a coated layer on a surface of the thin steel sheet according to claim 2.

5. The coated steel sheet according to claim 3, wherein the coated layer is a hot-dip galvanized layer or a hot-dip galvannealed layer, and the coated layer contains, on a percent by mass basis, Fe: 20.0% or less by mass, Al: 0.001% or more by mass and 1.0% or less by mass, and 0% or more by mass and 3.5% or less by mass in total of one or two or more selected from Pb, Sb, Si, Sn, Mg, Mn, Ni, Cr, Co, Ca, Cu, Li, Ti, Be, Bi, and REM, the balance being Zn and incidental impurities.

6. The coated steel sheet according to claim 4, wherein the coated layer is a hot-dip galvanized layer or a hot-dip galvannealed layer, and the coated layer contains, on a percent by mass basis, Fe: 20.0% or less by mass, Al: 0.001% or more by mass and 1.0% or less by mass, and 0% or more by mass and 3.5% or less by mass in total of one or two or more selected from Pb, Sb, Si, Sn, Mg, Mn, Ni, Cr, Co, Ca, Cu, Li, Ti, Be, Bi, and REM, the balance being Zn and incidental impurities.

7. The steel sheet according to claim 1, wherein the steel sheet has a yield ratio of 0.64 or less and in which an n value obtained in the range of the yield point to a strain of 5% is 0.160 or more and the n value obtained in the range of a strain of 5% to a strain of 10% is 0.180 or more.

8. The steel sheet according to claim 1, wherein the steel sheet has a reduction in elongation of 2% or less.

9. A method for producing a hot-rolled steel sheet according to claim 1, comprising heating a steel having the component composition to 1,100° C. or higher and 1,300° C. or lower and subjecting the steel to hot rolling including rough rolling and finish rolling, cooling, and coiling, wherein a total reduction ratio from a third pass, counting back from a final pass, to the final pass in the finish rolling is 40% or less, a finish rolling temperature is 880° C. or higher, a time from a completion of the finish rolling to a start of the cooling is 5 seconds or more, and a coiling temperature is 610° C. or higher and 690° C. or lower.

10. A method for producing a hot-rolled steel sheet according to claim 2, comprising heating a steel having the component composition to 1,100° C. or higher and 1,300° C. or lower and subjecting the steel to hot rolling including rough rolling and finish rolling, cooling, and coiling, wherein a total reduction ratio from a third pass, counting back from a final pass, to the final pass in the finish rolling is 40% or less, a finish rolling temperature is 880° C. or higher, a time from a completion of the finish rolling to a start of the cooling is 5 seconds or more, and a coiling temperature is 610° C. or higher and 690° C. or lower.

11. A method for producing a full hard cold-rolled steel sheet, comprising subjecting a hot-rolled steel sheet produced by the production method according to claim 9 to cold rolling.

12. A method for producing a full hard cold-rolled steel sheet, comprising subjecting a hot-rolled steel sheet produced by the production method according to claim 10 to cold rolling.

13. A method for producing a thin steel sheet, comprising subjecting a full hard cold-rolled steel sheet produced by the production method according to claim 11 to annealing under conditions at a dew point of −40° C. or lower in a temperature range of 600° C. or higher, an annealing temperature of 740° C. or higher and 810° C. or lower, an average cooling rate of 20° C./s or less from a cooling start temperature to 700° C., and a cooling stop temperature of 200° C. or higher and 550° C. or lower.

14. A method for producing a thin steel sheet, comprising subjecting a full hard cold-rolled steel sheet produced by the production method according to claim 12 to annealing under conditions at a dew point of −40° C. or lower in a temperature range of 600° C. or higher, an annealing temperature of 740° C. or higher and 810° C. or lower, an average cooling rate of 20° C./s or less from a cooling start temperature to 700° C., and a cooling stop temperature of 200° C. or higher and 550° C. or lower.

15. A method for producing a coated steel sheet, comprising coating a thin steel sheet produced by the production method according to claim 13.

16. A method for producing a coated steel sheet, comprising coating a thin steel sheet produced by the production method according to claim 14.

* * * * *